US006905399B2

(12) United States Patent
Lischka

(10) Patent No.: US 6,905,399 B2
(45) Date of Patent: Jun. 14, 2005

(54) CONDITIONING MECHANISM FOR CHEMICAL MECHANICAL POLISHING

(75) Inventor: David J. Lischka, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 76 days.

(21) Appl. No.: 10/411,752

(22) Filed: Apr. 10, 2003

(65) Prior Publication Data

US 2004/0203326 A1 Oct. 14, 2004

(51) Int. Cl.[7] ..... B24B 53/03

(52) U.S. Cl. ..... 451/72; 451/41; 451/57; 451/63; 384/132

(58) Field of Search ..... 451/443, 444, 451/285–289, 41, 56, 57, 63, 397, 398, 450; 384/132, 134, 478

(56) References Cited

U.S. PATENT DOCUMENTS 6,019,670 A * 2/2000 Cheng et al. ..... 451/56
6,200,199 B1 * 3/2001 Gurusamy et al. ..... 451/56
6,293,853 B1 * 9/2001 Perlov et al. ..... 451/56
6,299,511 B1 * 10/2001 Gurusamy et al. ..... 451/56
6,306,008 B1 * 10/2001 Moore ..... 451/5
6,607,427 B2 * 8/2003 Togawa et al. ..... 451/56
2001/0006873 A1 * 7/2001 Moore ..... 451/5
2003/0166383 A1 * 9/2003 Kimura et al. ..... 451/56

* cited by examiner

*Primary Examiner*—Joseph J. Hail, III
*Assistant Examiner*—Anthony Ojini
(74) *Attorney, Agent, or Firm*—Moser, Patterson & Sheridan

(57) ABSTRACT

Embodiments of a conditioning mechanism for a chemical mechanical polishing system have been provided. In one embodiment, a conditioning mechanism includes a rotor assembly and a conditioning element mounting assembly. A seal is disposed between the rotor assembly and conditioning element mounting assembly and bounds one surface of an expandable plenum defined between the rotor assembly and conditioning element mounting assembly. A spring is disposed between the rotor and conditioning element mounting assemblies and is adapted to bias a lower surface of the conditioning element mounting assembly towards the rotor assembly.

26 Claims, 5 Drawing Sheets

CONDITIONING MECHANISM FOR CHEMICAL MECHANICAL POLISHING

BACKGROUND OF THE INVENTION

1. Field of the Invention

Embodiments of the present invention generally relate to a mechanism for conditioning a polishing surface in a chemical mechanical polishing system.

2. Description of the Related Art

Chemical mechanical polishing is one process commonly used in the manufacture of high-density integrated circuits. Chemical mechanical polishing is utilized to planarize a layer of material deposited on a semiconductor wafer by moving the substrate in contact with a polishing surface while in the presence of a polishing fluid. Material is removed from the surface of the substrate that is in contact with the polishing surface through a combination of chemical and mechanical activity.

In order to achieve desirable polishing results, the polishing surface must be dressed or conditioned periodically. One type of conditioning process, typically performed on polyurethane polishing pads traditionally utilized in chemical mechanical polishing, is configured to restore the fluid retention characteristics of the polishing surface and to remove embedded material from the polishing surface. Another type of conditioning process, typically performed on fixed abrasive polishing material, is configured to expose abrasive articles disposed within structures comprising the abrasive polishing material, while removing asperities from the upper surface of the polishing material and leveling the structures comprising the polishing surface to a uniform height.

In one embodiment, a polishing surface conditioner includes a replaceable conditioning element, such as a diamond disk, coupled to a conditioning head that is movable over the polishing surface. The diamond disk is lowered into contact with the polishing surface while being rotated. The conditioning head is generally swept across the rotating polishing surface to allow the diamond disk to condition a predefined area.

Conventional conditioners commonly utilize diaphragms to force the conditioning head against the polishing surface during conditioning. Typically, more force is applied near the centerline of the diaphragm, while less force applied at the perimeter of the diaphragm which is fixed to a housing. As fixed abrasive polishing material is relatively soft as compared to conventional polyurethane polishing pads, the non-uniform force applied to the polishing surface by the conditioner may result in uneven conditioning.

Moreover, care must be exercised while moving the conditioner over the polishing material to avoid inadvertent contact between the conditioning head and the fixed abrasive polishing material which may result in gouging or otherwise damaging the polishing material. If the vacuum applied to the diaphragm holding up the polishing head is disabled, or the diaphragm fails, the polishing head will suddenly drop, causing the conditioning head to collide with the polishing surface. Collision between the conditioning head and polishing surface generally result in damaging at least the polishing surface or the conditioning head. Once the polishing material is damaged, that section of the polishing material must be discarded (i.e., not used for polishing) thereby disadvantageously reducing the number of substrates that may be polished per unit quantity of polishing material, resulting in decreased throughput and an increased cost of consumables (e.g., the polishing material).

Therefore, there is a need for an improved conditioning mechanism.

SUMMARY OF THE INVENTION

Embodiments of a conditioning mechanism for a chemical mechanical polishing system have been provided. In one embodiment, a conditioning mechanism includes a rotor assembly and a conditioning element mounting assembly. A seal is disposed between the rotor assembly and conditioning element mounting assembly and bounds one surface of an expandable plenum defined between the rotor assembly and conditioning element mounting assembly. A spring is disposed between the rotor and conditioning element mounting assemblies and is adapted to bias a lower surface of the conditioning element mounting assembly towards the rotor assembly.

BRIEF DESCRIPTION OF THE DRAWINGS

A more particular description of the invention, briefly summarized above, may be had by reference to the embodiments thereof that are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, wherever possible, to designate identical elements that are common to the figures.

DETAILED DESCRIPTION

Figure 1:
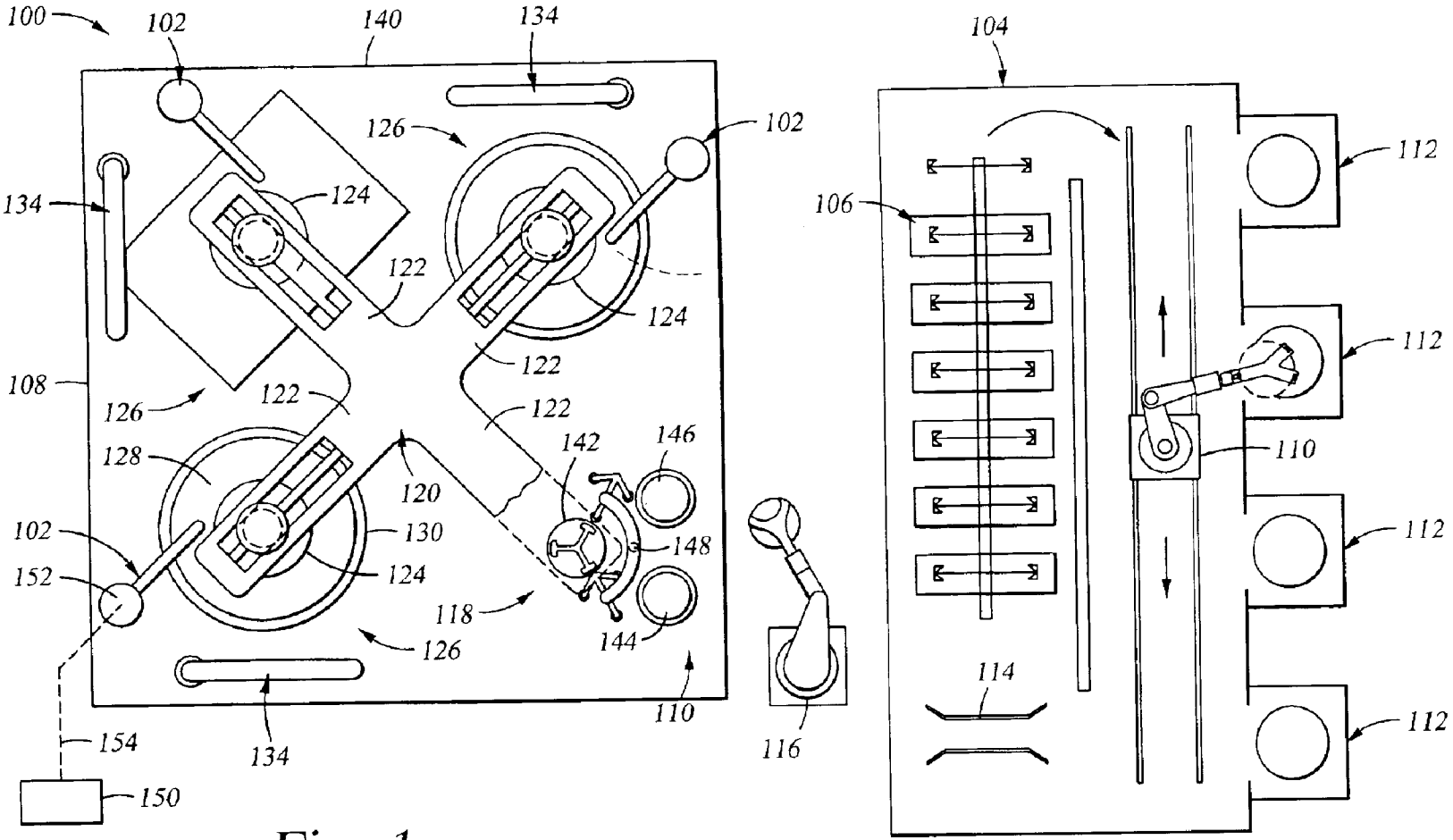
FIG. 1 is a top view of an illustrative chemical mechanical polishing system having one embodiment of a conditioning mechanism.

FIG. 1 is a top view of an illustrative chemical mechanical polishing system 100 having one embodiment of a conditioning mechanism 134 of the present invention. The chemical mechanical polishing system 100 generally includes a factory interface 104, a cleaner 106 and a polisher 108. One polishing system 100 that may be adapted to benefit from the invention is a REFLEXION® chemical mechanical polishing system available from Applied Materials, Inc., located in Santa Clara, Calif. Another polishing system 100 that may be adapted to benefit from the invention is described in U.S. Pat. No. 6,244,935, issued Jun. 12, 2001, to Birang, et al., which is incorporated by reference in its entirety.

In one embodiment, the factory interface 104 includes a first or interface robot 110 adapted to transfer substrates from one or more substrate storage cassettes. 112 to a first transfer station 114. A second robot 116 is positioned between the factory interface 104 and the polisher 108 and is configured to transfer substrates between the first transfer station 114 of the factory interface 104 and a second transfer station 118 disposed on the polisher 108. The cleaner 106 is typically disposed in or adjacent to the factory interface 104 and is adapted to clean and dry substrates returning from the polisher 108 before being returned to the substrate storage cassettes by the interface robot 110.

The polisher 108 includes at least one polishing station 126 and a transfer device 120 disposed on a base 140. In the embodiment depicted in FIG. 1, the polisher 108 includes three polishing stations 126, each having a platen 130 that supports a polishing material 128 on which the substrate is processed.

The transfer device 120 supports at least one polishing head 124 that retains the substrate during processing. In the embodiment depicted in FIG. 1, the transfer device 120 is a carousel supporting one polishing head 124 on each of four arms 122. One arm 122 of the transfer devices is cutaway to show the second transfer station 118. The transfer device 120 facilitates moving substrates retained in each polishing head 124 between the second transfer station 118 and the polishing stations 126 where substrates are processed. The polishing head 124 is configured to retain a substrate while polishing. The polishing head 124 is coupled to a transport mechanism that is configured to move the substrate retained in the polishing head 124 between the transfer station 118 and the polishing stations 126. One polishing head 124 that may be adapted to benefit from the invention is a TITAN HEAD™ substrate carrier, available from Applied Materials, Inc.

The second transfer station 118 includes a load cup 142, an input buffer 144, an output buffer 146 and a transfer station robot 148. The input buffer 144 accepts a substrate being transferred to the polisher 108 from the second robot 116. The transfer station robot 148 transfers the substrate from the input buffer 144 to the load cup 142. The load cup 142 transfers the substrate vertically to the polishing head 124, which retains the substrate during processing. Polished substrates are transferred from the polishing head 124 to the load cup 142, and then moved by the transfer station robot 148 to the output buffer 146. From the output buffer 146, polished substrates are transferred to the first transfer station 114 by the second robot 118 and then transferred through the cleaner 106. One second transfer station 118 that may be adapted to benefit from the invention is described in U.S. Pat. No. 6,156,124, issued Dec. 5, 2000, to Tobin, which is incorporated by reference in its entirety.

A polishing fluid delivery system 102 includes at least one polishing fluid supply 150 coupled to at least one polishing fluid delivery arm assembly 152. Generally, each polishing station 126 is equipped with a respective delivery arm assembly 152 positioned proximate to a respective platen 130 to provide polishing fluid thereto during polishing. In the embodiment depicted in FIG. 1, the three polishing stations 126 each have one delivery arm assembly 152 associated therewith.

The platen 130 of each polishing station 126 supports a polishing material 128. During processing, the substrate is held against the polishing material 128 by the polishing head 124 in the presence of polishing fluid provided by the delivery system 102. The platen 130 rotates to provide at least a portion of the polishing motion imparted between the substrate and the polishing material 128. Alternatively, the polishing motion may be imparted by moving at least one of the polishing head 124 or polishing material 128 in a linear, orbital, random, rotary or other motion.

The polishing material 128 may be comprised of a foamed polymer, such as polyurethane, or may be a fixed abrasive material. Fixed abrasive material generally includes a plurality of abrasive elements disposed on a flexible backing. In one embodiment, the abrasive elements are comprised of geometric shapes formed from abrasive particles suspended in a polymer binder. The polishing material 128 may be in either pad or web form.

One conditioning mechanism 134 is disposed proximate each polishing station 126 and is adapted to dress or condition the polishing material 128 disposed on each platen 130. Each conditioning mechanism 134 is adapted to move between a position clear of the polishing material 128 and platen 130 as shown in FIG. 1, and a conditioning position over the polishing material 128. In the conditioning position, the conditioning mechanism 134 engages the polishing material 128 to work the surface of the polishing material 128 to a state that produces desirable polishing results.

Figure 2:
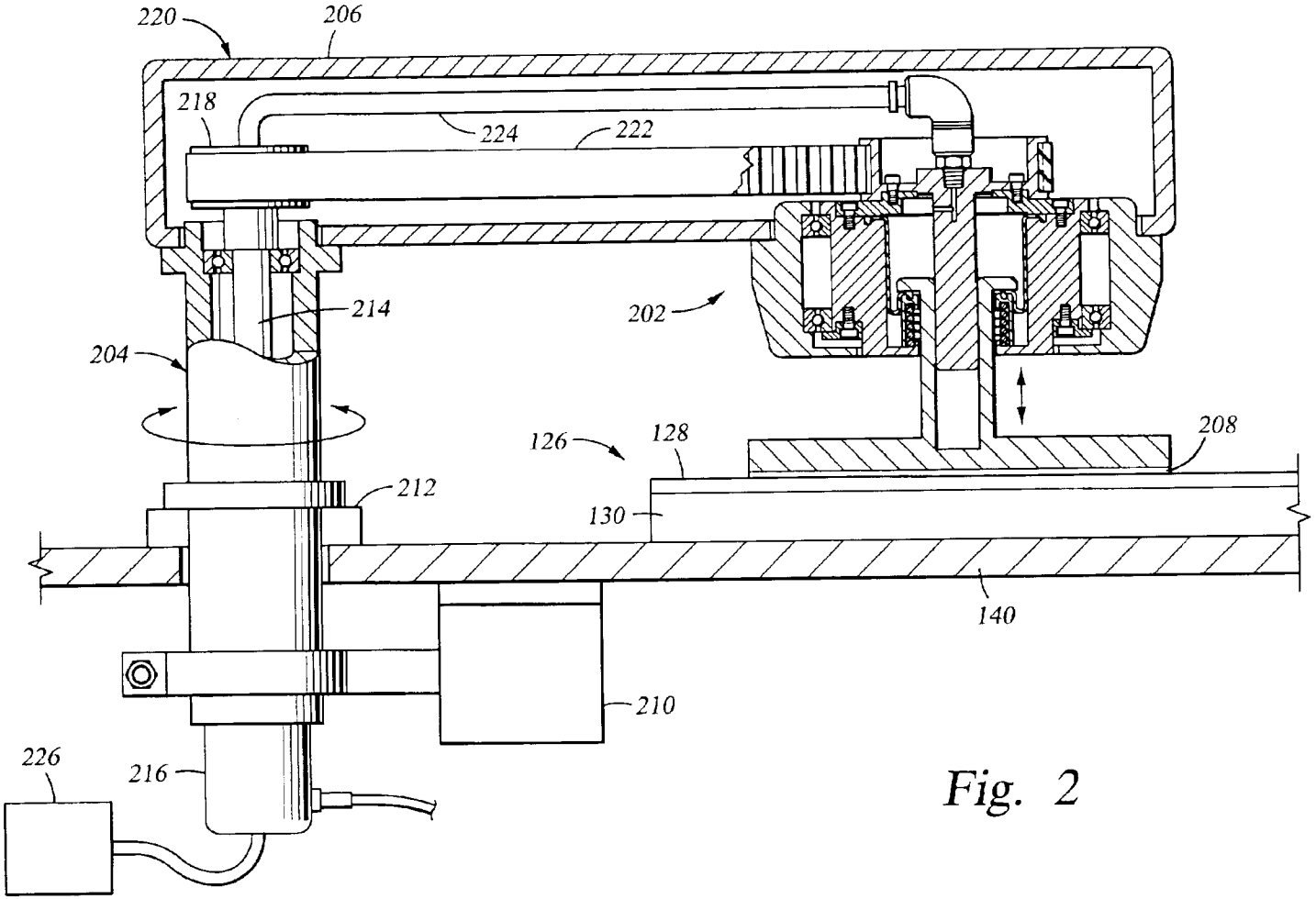
FIG. 2 is a sectional side view of one embodiment of the conditioning mechanism of FIG. 1.

FIG. 2 is a sectional view of one embodiment of a conditioning mechanism 134. The conditioning mechanism 134 generally includes a head assembly 202 coupled to a support member 204 by an arm 206. The support member 204 is disposed through the base 140 of the polisher 108. Bearings 212 are provided between the base 140 and the support member 204 to facilitate rotation of the support member 204. An actuator 210 is coupled between the base 140 and the support member 204 to control the rotational orientation of the support member 204. The actuator 210, such as a pneumatic cylinder, AC servo motor, motorized ball screw, harmonic drive or other motion control device that is adapted to control the rotational orientation of the support member 204, allows the arm 206 extending from to the support member 204 to be rotated about the support member 204, thus laterally positioning the head assembly 202 relative to the polishing station 126. A conditioning element 208 is coupled to the bottom of the head assembly 202 and may be selectively pressed against the platen 130 while rotating to condition the polishing material 128.

The support member 204 houses a drive shaft 214 coupling a motor 216 disposed below the base 140 to a pulley 218 disposed adjacent a first end 220 of the arm 206. A belt 222 is disposed in the arm 206 and operably couples the pulley 218 and the head assembly 202, thereby allowing the motor 216 to selectively rotate the conditioning element 208. The belt 222 is contemplated as any member adapted to transfer rotational motion between two rotatable bodies.

A control fluid conduit 224 from a fluid control system 226 is routed through the support member 204 and arm 206, and is couple to the head assembly 202. The fluid control system 226 includes a gas supply and various control devices (i.e., valves, regulators and the like) that facilitate the application and/or removal of fluid pressure to the motion of the head assembly 202. In one embodiment, the fluid control system 226 provides air or nitrogen to control the elevation of the conditioning element 208 relative to the platen 130, and to control the pressure applied by the conditioning element 208 against the polishing material 128 during conditioning.

Figure 3:
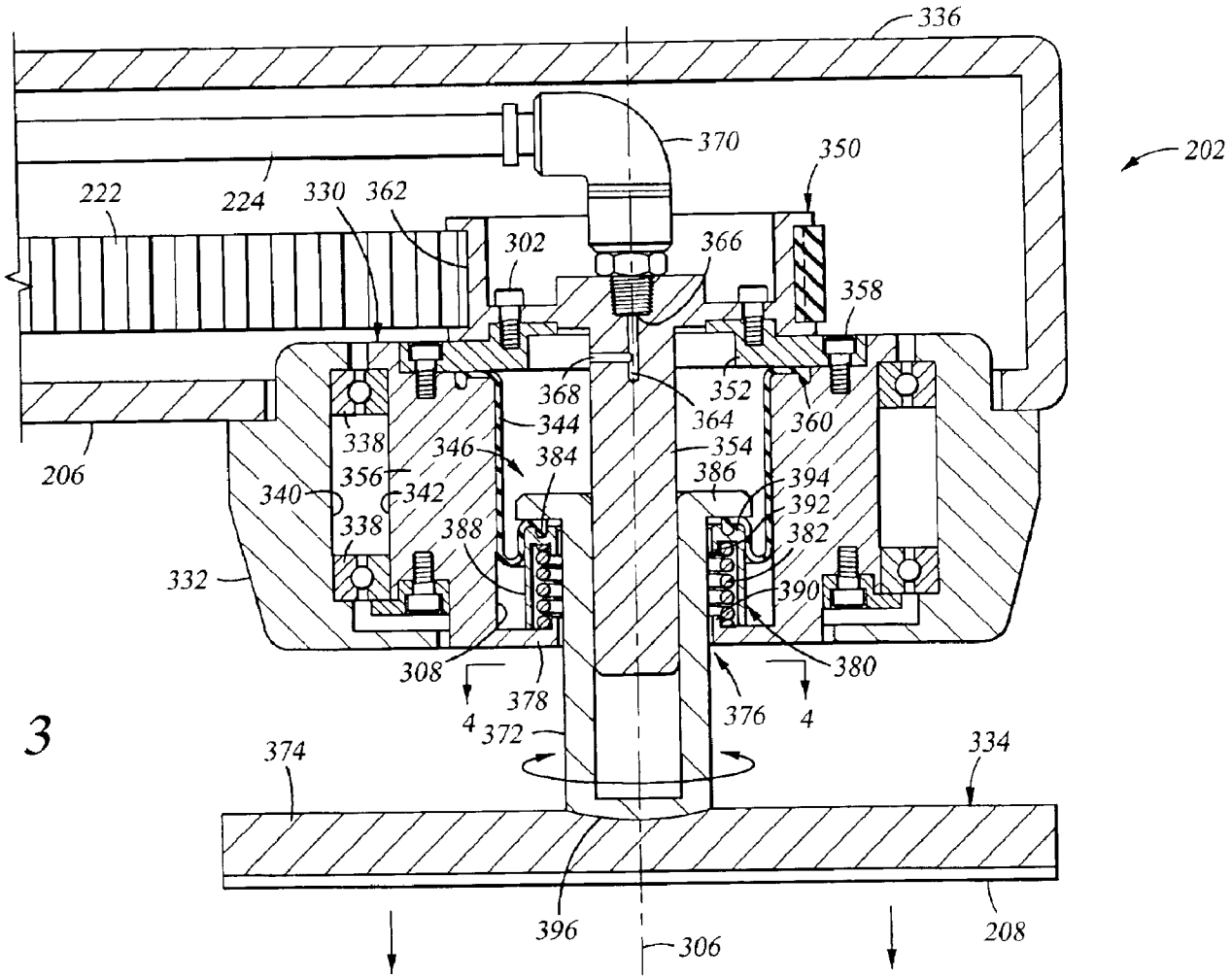
FIG. 3 is a sectional side view of one embodiment of a head assembly.

FIG. 3 is a sectional view of the head assembly 202. The head assembly 202 includes a rotor assembly 330, a housing 332 and a conditioning element mounting assembly 334. A seal 344 is disposed between the rotor assembly 330 and the conditioning element mounting assembly 334. The seal 344 provides a portion of the boundary of an expandable plenum 346 defined between the rotor assembly 330 and the conditioning element mounting assembly 334. The plenum 346 is coupled by the control fluid conduit 224 to the fluid control system 226 and may be pressurized to urge the conditioning element mounting assembly 334 away from the rotor assembly 330 to engage the polishing material 128.

The housing 332 is coupled to a second end 336 of the arm 206. The housing 332 is generally an annular member having an inner diameter 340 configured to fit the rotor assembly 330 concentrically therein. A bearing assembly 338 is disposed between the inner diameter 340 of the housing 332 and an outer diameter 342 of the rotor assembly 330 to facilitate smooth concentric rotation of the rotor assembly 330 within the housing 332.

The rotor assembly 330 includes a sheave 350, a clamp ring 352, a stem 354 and a rotor body 356. The rotor body 356 is bounded by the bearing assembly 338 and has a generally hollow cylindrical form. The clamp ring 352 is coupled to the upper portion of the rotor body 356 by a plurality of fasteners 358. The fasteners 358 urge a lower surface of the clamp ring 352 against the rotor body 356, thereby sealingly clamping a first end 360 of the seal 344 between the rotor body 356 and clamp ring 352. An upper surface of the clamp ring 352 is coupled to the sheave 350 by fasteners 302. The sheave 350 includes a pulley 362 oriented parallel to the base 140. The sheave is coupled to the stem 354 extending therefrom downward along a central axis 306. The pulley 362 is driven by the belt 222 and transfers its rotational motion through the rotor assembly 330 to the conditioning element mounting assembly 334. The pulley 362 has a first port 366 formed therein concentric to the central axis 306. The first port 366 is coupled to a passage 364 extending through the pulley 362 and downward into the stem 354. The passage 364 exits the stem 354 at a second port 368. The second port 368 is positioned on the stem 354 to allow fluid to be introduced and removed from the expandable plenum 346, thereby imparting vertical motion to the conditioning element mounting assembly 334 relative to the rotor assembly 330. A rotary union 370 is coupled between the first port 366 and the control fluid conduit 224 to allow passage of fluid through the passage 364 while the rotor assembly 330 is rotating.

The conditioning element mounting assembly 334 includes a sleeve 372 and a mounting flange 374. The sleeve 372 and mounting flange 374 are coupled by a gimbal 396 that allows the angular orientation of the mounting flange 374 to align with the polishing material 128 during conditioning. The mounting flange 374 extends radially outward from one end of the sleeve 372 and is configured to accept the conditioning element 208. The conditioning element 208 may be clamped, adhered or otherwise removably coupled to the lower surface of the mounting flange 374 that faces the platen 130.

The sleeve 372 extends through an aperture 376 defined by a flange 378 extending radially inward from the lower edge of the inner diameter 308 of the rotor body 356. The sleeve 372 is generally hollow is configured to slide axially over the stem 354 along the axis 306. The sleeve 372 and stem 354 may be keyed or have other geometry that facilitates axial translation of the sleeve relative to the stem, while preventing relative rotational motion therebetween.

Figure 4:
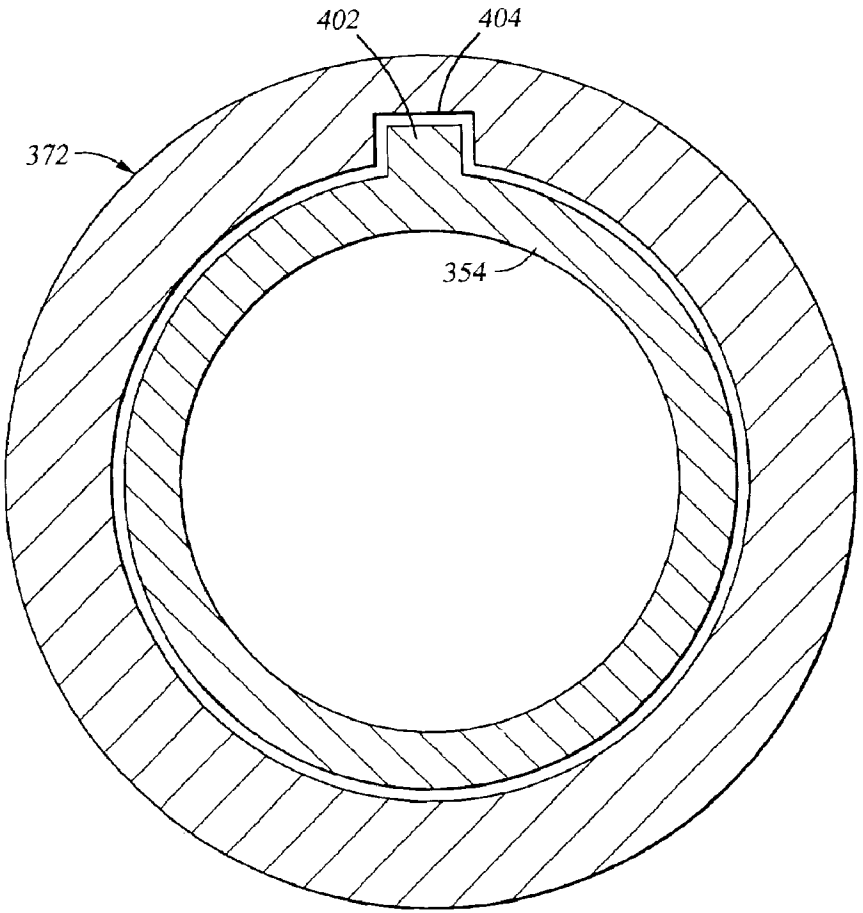
FIG. 4 is a partial sectional view of the head assembly taken along section line 4—4 of FIG. 3.

In the embodiment depicted in the sectional view of FIG. 4, the stem 354 includes a key 402 that engages a slot 404 formed in the sleeve 372. The key 402 and slot 404 interface to allow linear motion in an axial direction while preventing rotation. A separate key other interlocking or engaging geometries that prevent relative rotation are also contemplated. Alternatively, guide pins parallel to the axis 306 may be disposed between the rotor assembly 330 and mounting assembly 334.

Figure 5:
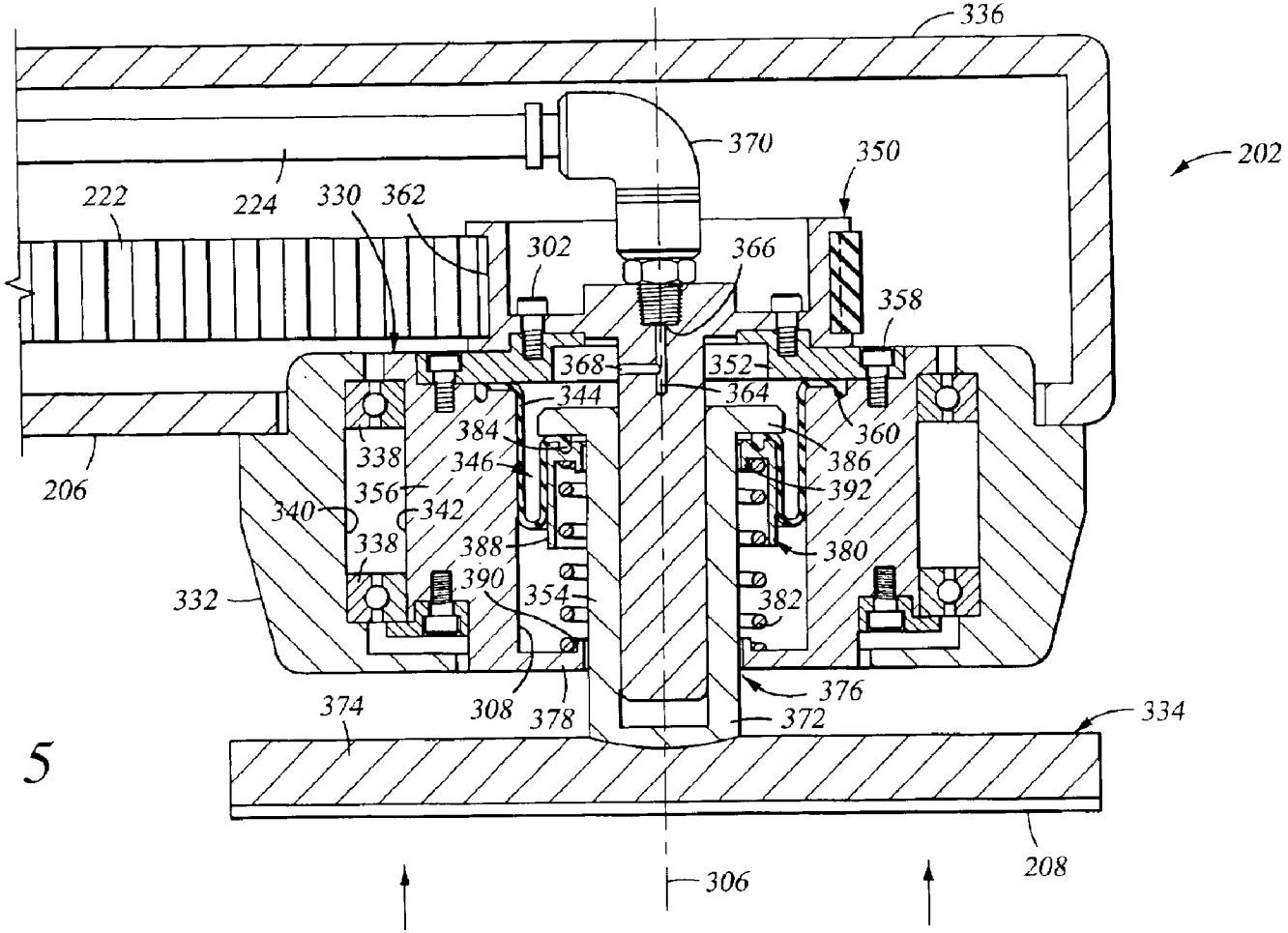
FIG. 5 is a sectional side view of the head assembly of FIG. 3 in a retracted position.

Returning to FIG. 3, a spring 382 is disposed concentrically around the sleeve 372 and is adapted to bias the mounting flange 374 towards the housing 332 and rotor body 336. The spring 382 is generally selected to support the rotor assembly 330 in a retracted position (e.g., a position that maintains the conditioning element 208 and the upper surface of the polishing material 128 in a spaced-apart relation as depicted in FIG. 5), thereby avoiding inadvertent contact therebetween that may result in damage to the polishing material 128. Moreover, the bias provided by the spring 382 urging the rotor assembly 330 away from the polishing material 128 additionally provides fail-safe operation, preventing contact during electrical or pneumatic failure of the system. The counter force provided by the spring 382 against the weight of the rotor assembly 330 also allows for a lower net down force against the polishing material 128 while using higher and more easily regulated control pressure for better control and resolution of the force of the conditioning element 208 against the polishing material 128

A cap 386 extends radially outwardly from a distal end of the sleeve 372 opposite the mounting flange 374. The cap 386 may be a nut engaged with a threaded portion of the sleeve 372. A cage 380 is secured by means not shown to at least one of the cap 386 or sleeve 372, sealingly clamping a second end 384 of the seal 344 therebetween. The cage 380 additionally includes a cylindrical section 388 having a diameter greater than the aperture 376 of the rotor body 356 that bounds the outer diameter of the spring 382. The cylindrical section 388 may have a height selected to control the stroke (e.g., downward movement) of the conditioning element mounting assembly 334 as the cage 380 is squeezed between the cap 386 and flange 378 when the pressure is applied to the plenum 346 to actuate the conditioning element mounting assembly 334 downward.

The cage 380 also includes a flange 394 that extend radially inward from the upper end of the cylindrical section 388. A lip 392 extends downward from the inner edge of the flange 394 to capture one end of the spring 382 between the flange 394 and the cylindrical section 388. The second end of the spring 382 is retained between the cylindrical section 388 of the cage 380 and a lip 390 extending upwardly from the flange 378 of the housing 332.

In one embodiment, the seal 344 is a rolling diaphragm. The inner diameter 308 of rotor body 356 provides an outer support surface for the rolling diaphragm as the conditioning element mounting assembly 334 moves downward. The cylindrical body 388 of the cage 380 provides an inner support surface for the rolling diaphragm as the conditioning element mounting assembly 334 is retracted by the spring 382. Thus, the seal 344 configured as a rolling diaphragm provides uniform pressure in a direction defined by the central axis 376 across the width of the conditioning element 208 and mounting flange 374 as the plenum 346 is pressurized without a lateral force component, thereby enhancing conditioning uniformity.

Thus, a conditioning mechanism has been provided that is mechanically biased away from a polishing surface, thus advantageously reducing the potential incidence of inadvertent contact with a polishing material disposed on the polishing surface, thereby preventing damage to the polishing surface which prolongs the life of the polishing material and reduces substrate defects. Moreover, in one embodiment, the inclusion of a rolling diaphragm enhances the uniform application of pressure to the polishing surface during conditioning, advantageously enhancing conditioning uniformity and substrate polishing performance.

While the foregoing is directed to the preferred embodiment of the present invention, other and further embodiments of the invention may be devised without departing from the basic scope thereof, and the scope thereof is determined by the claims that follow.

What is claimed is:

1. A conditioning mechanism comprising:

a rotor assembly;

a conditioning element mounting assembly having a lower surface adapted to receive a conditioning element;

a sheave having a gas passage formed therethrough;

a stem extending from the sheave along an axis of rotation of the sheave and providing an axial bearing surface for the conditioning element mounting assembly;

a rotor body disposed concentrically to the stem and coupled to the sheave;

wherein the conditioning element mounting assembly further comprises:

a) a sleeve disposed over the stem of the rotor assembly and adapted to move coaxially thereto; and b) a mounting flange extending radially outward from an end of the sleeve positioned beyond the rotor body;

a seal disposed between the rotor assembly and the conditioning element mounting assembly and bounding one surface of an expandable plenum defined between the rotor assembly and the conditioning element mounting assembly; and a spring disposed between the rotor assembly and the conditioning element mounting assembly and adapted to bias the mounting flange towards the rotor assembly, wherein the spring is retained between a flange of the sleeve extending outwardly from an end of the sleeve opposite the mounting flange and an inwardly disposed flange extending from the rotor body and circumscribing the sleeve.

2. The conditioning mechanism of claim 1, wherein the rotor assembly further comprises:

a cylindrical member; and a flange extending inward from the cylindrical member that retains the spring.

3. The conditioning mechanism of claim 1, wherein the seal further comprises:

a rolling diaphragm having a first end coupled to the rotor assembly and a second end coupled to the conditioning element mounting assembly.

4. The conditioning mechanism of claim 1 further comprising:

a housing circumscribing the rotor assembly; and a bearing disposed between the housing and rotor assembly facilitating rotary motion therebetween.

5. A conditioning mechanism comprising:

a conditioning element mounting assembly having a sleeve and a mounting pad extending radially outward from a first end of the sleeve, the mounting pad adapted to receive a conditioning element;

a rotor assembly having a sheave adapted to engage a drive belt and a stem extending coaxially from the sheave and slidably engaging the sleeve;

a rolling diaphragm having a first end coupled to the rotor assembly and at a second end coupled to a second end of the sleeve; and a spring disposed between the rotor assembly and the conditioning element mounting assembly and adapted to bias the mounting pad towards the rotor assembly.

6. The conditioning mechanism of claim 5 further comprising:

a rotary union coupled to a gas passage formed through the rotor assembly;

a housing circumscribing the rotor assembly; and a bearing disposed between the housing and rotor assembly facilitating rotary motion therebetween.

7. The conditioning mechanism of claim 6 further comprising:

a support post;

an arm coupling the housing to the support post; and a drive pulley disposed proximate to the support post and coupled by a drive belt to the sheave.

8. The conditioning mechanism of claim 5 further comprising:

a cage coupled to the sleeve and having a cylindrical section disposed coaxially over the spring, the cylindrical section providing an inner lateral support surface for the rolling diaphragm.

9. The conditioning mechanism of claim 8, wherein the rotor assembly further comprises:

a rotor body having an inner diameter orientated coaxial to the sleeve and providing an outer lateral support surface for the rolling diaphragm.

10. The conditioning mechanism of claim 5, wherein the stem and sleeve are engaged in a manner to prevent relative rotation therebetween.

11. The conditioning mechanism of claim 5, wherein the stem further comprises:

a key extending into a slot formed in the sleeve.

12. The conditioning mechanism of claim 5, wherein the sleeve further comprises:

a cap extending radially outward from an end of the sleeve opposite the mounting pad.

13. The conditioning mechanism of claim 12, wherein the spring is retained between a flange extending radially inward from the rotor assembly and the cap of the sleeve.

14. The conditioning mechanism of claim 5, wherein the rotor assembly further comprises a passage formed therethrough and coupled to an expandable plenum defined between the rotor assembly and the conditioning element mounting assembly.

15. A conditioning mechanism comprising:

a cylindrical housing;

an annular rotor body rotatably disposed in the cylindrical housing;

a bearing assembly disposed between the annular rotor body and cylindrical housing;

a sheave coupled to the annular rotor body and adapted to engage a belt;

a stem extending downward from the sheave and at least partially through a center of the annular rotor body along an axis of rotation;

a sleeve slidably disposed around the stern and extending beyond the cylindrical housing;

a mounting pad extending radially outward from a first end of the sleeve positioned below the cylindrical housing, the mounting pad adapted to receive a conditioning element;

a rolling diaphragm having a first end coupled to the annular rotor body and at a second end coupled to a second end of the sleeve; and a spring disposed between a flange extending radially inwards from the annular rotor body and a cap disposed at the second end of the sleeve, the spring adapted to bias the mounting pad towards the cylindrical housing.

16. The conditioning mechanism of claim 15 further comprising:

a support post;

an arm coupling the cylindrical housing to the support post; and a drive pulley disposed proximate to the support post and coupled by a belt to the sheave.

17. A conditioning mechanism comprising:

a rotor assembly having a stem extending therefrom;

a conditioning element mounting assembly having a sleeve slidably engaging the stem;

a rolling diaphragm having a first end coupled to the rotor assembly and a second end coupled to the conditioning element mounting assembly; and a spring disposed between the rotor assembly and the conditioning element mounting assembly and adapted to bias the conditioning element mounting assembly towards the rotor assembly, wherein the stem and sleeve are engaged in a manner to prevent relative rotation therebetween.

18. The conditioning mechanism of claim 17 further comprising:

a housing circumscribing the rotor assembly; and a bearing disposed between the housing and rotor assembly facilitating rotary motion therebetween.

19. The conditioning mechanism of claim 18 further comprising:

a support post;

an arm coupling the housing to the support post; and a drive pulley disposed proximate to the support post and coupled by a drive belt to the rotor assembly.

20. The conditioning mechanism of claim 17 further comprising:

a cage coupled to the sleeve and having a cylindrical section disposed coaxially over the spring, the cylindrical section providing an inner lateral support surface for the rolling diaphragm.

21. The conditioning mechanism of claim 17, wherein the rotor assembly further comprises:

a rotor body having an inner diameter orientated coaxial to the sleeve and providing an outer lateral support surface for the rolling diaphragm.

22. The conditioning mechanism of claim 17, wherein the stem further comprises:

a key extending into a slot formed in the sleeve.

23. The conditioning mechanism of claim 17, wherein the rotor assembly further comprises a passage formed therethrough and coupled to an expandable plenum defined between the rotor assembly and the conditioning element mounting assembly.

24. A conditioning mechanism comprising:

a rotor assembly having a stem extending therefrom;

a conditioning element mounting assembly having a sleeve slidably engaging the stem;

a rolling diaphragm having a first end coupled to the rotor assembly and a second end coupled to the conditioning element mounting assembly; and a spring disposed between the rotor assembly and the conditioning element mounting assembly and adapted to bias the conditioning element mounting assembly towards the rotor assembly, wherein the sleeve further comprises:

a cap extending radially outward from an end of the sleeve opposite the mounting pad.

25. The conditioning mechanism of claim 24, wherein the spring is retained between a flange extending radially inward from the rotor assembly and the cap of the sleeve.

26. The conditioning mechanism of claim 24 further comprising:

a rotary union coupled to the rotor assembly and adapted to provide fluid to a plenum defined in the rotor assembly at least partially by the rolling diaphragm for biasing the conditioning element mounting assembly against a force produced by the spring.

* * * * *

UNITED STATES PATENT AND TRADEMARK OFFICE

CERTIFICATE OF CORRECTION

PATENT NO. : 6,905,399 B2
APPLICATION NO. : 10/411752
DATED : June 14, 2005
INVENTOR(S) : David J. Lischka It is certified that error appears in the above-identified patent and that said Letters Patent is hereby corrected as shown below:

On the Cover of the Patent

Item [56], References Cited, U.S. PATENT DOCUMENTS: Please add the following references:

| | | |
|---|---|---|
| 5,738,574 | 4/1998 | Tolles et al. .....451/288 |
| 6,135,868 | 10/2000 | Brown et al. .....451/443 |
| 6,322,429 | 11/2001 | Wilson et al. .....451/72 |
| 6,386,963 | 5/2002 | Kenji et al. .....451/443 |
| 6,514,126 | 2/2003 | Vanell .....451/72 |
| 2002/0164939 | 11/2002 | Kuo et al. .....451/443 |

In the Specification

Column 2, Line 55: Insert a comma after “system”

Column 2, Line 62: Delete the period after “cassettes”

Signed and Sealed this

Fifteenth Day of August, 2006

JON W. DUDAS
*Director of the United States Patent and Trademark Office*